US007516582B2

(12) United States Patent
Leek

(10) Patent No.: US 7,516,582 B2
(45) **Date of Patent: *Apr. 14, 2009**

(54) AUTOMATIC TAKE-UP DEVICE WITH INTERNAL SPRING

(75) Inventor: William F. Leek, Carmel, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 560 days.

This patent is subject to a terminal disclaimer.

(21) Appl. No.: 10/626,787

(22) Filed: Jul. 23, 2003

(65) Prior Publication Data

US 2005/0034391 A1 Feb. 17, 2005

Related U.S. Application Data

(63) Continuation of application No. 09/729,491, filed on Dec. 3, 2000, now abandoned.

(51) Int. Cl.
*E02D 5/74* (2006.01)
*E04D 5/76* (2006.01)

(52) U.S. Cl. ..... 52/223.1; 52/223.13; 52/223.14; 52/293.3; 52/296; 52/298; 411/231; 411/917; 74/441

(58) Field of Classification Search ..... 52/295, 52/293.3, 296, 223.1, 223.13, 223.14, 298, 52/702, 714; 411/231, 432, 917; 74/441, 74/409; 267/172, 170
See application file for complete search history.

(56) References Cited

U.S. PATENT DOCUMENTS 179,994 A 7/1876 Brallier
487,721 A 12/1892 De Kalb
518,165 A 4/1894 Thalaker
560,554 A 5/1896 Wiestner
581,551 A 4/1897 Green
582,424 A 5/1897 Hunt
856,868 A 6/1907 Heffner
1,344,417 A 6/1920 Lovekin (Continued)

FOREIGN PATENT DOCUMENTS

CA 2313735 7/2000

(Continued)

OTHER PUBLICATIONS

Description of Claims raised in Simpson Manufacturing Co., Inc. and Simpson Strong-Tie Company, Inc. v. Alfred D. Commins and Commins Manufacturing, Inc. (pp. 1 and2).

(Continued)

*Primary Examiner*—Phi Dieu Tran A
(74) *Attorney, Agent, or Firm*—James R. Cypher; Charles R. Cypher

(57) ABSTRACT

The present invention consists of a connection, having an anchored, elongated tension member, a fastening member attached to the elongated tension member, a resisting member that receives the elongated tension member and an expansion device that receives the elongated tension member there through. The expansion device is formed with a sleeve. First and second bearing members are received in the central aperture of the surrounding sleeve A torsion spring connects the first and second bearing members and is located within the surrounding sleeve. The torsion spring biases the first and second members in opposite rotational directions.

19 Claims, 13 Drawing Sheets

U.S. PATENT DOCUMENTS 1,347,687 A 7/1920 Ellis et al.
1,374,713 A 4/1921 Bell
1,589,307 A 6/1926 Svebilius
1,737,543 A * 11/1929 Mason ..... 411/231
1,746,978 A 2/1930 Winkler
1,867,296 A 7/1932 Woodruff
1,953,354 A 4/1934 Holland-Letz
1,966,780 A 7/1934 Wyrick
2,021,051 A 11/1935 Desbrueres
2,066,541 A 1/1937 Schenk
2,261,537 A 11/1941 Zamara
2,294,745 A 9/1942 Goetz
2,405,889 A 8/1946 Kennedy
2,587,560 A 2/1952 Widner
2,685,812 A 8/1954 Dmitroff
2,690,682 A * 10/1954 Passman ..... 74/441
2,896,496 A 7/1959 Jansen
3,104,645 A 9/1963 Harrison
3,115,804 A 12/1963 Johnson
3,118,681 A 1/1964 Fuehrer
3,157,215 A 11/1964 Zahodiakin
3,161,174 A 12/1964 Harrison
3,174,386 A 3/1965 Lewis
3,187,621 A 6/1965 Turner
3,285,120 A 11/1966 Kartiala
3,306,154 A 2/1967 Bailey
3,325,175 A 6/1967 Lower
3,429,092 A 2/1969 Perry et al.
3,440,334 A 4/1969 Blomstrand
3,469,492 A 9/1969 Dahl
3,476,010 A 11/1969 Markey
3,479,897 A * 11/1969 Holthofer ..... 74/441
3,728,933 A 4/1973 Grube
3,782,061 A 1/1974 Minutolie et al.
3,878,757 A 4/1975 Puklus, Jr.
3,948,141 A 4/1976 Shinjo
4,000,681 A 1/1977 Coldren
4,020,734 A 5/1977 Bell
4,037,516 A 7/1977 Hart
4,047,463 A 9/1977 Coldren
4,055,875 A 11/1977 Strickland
4,149,446 A 4/1979 Spengler et al.
4,286,482 A 9/1981 Marsch et al.
4,433,879 A 2/1984 Morris
4,479,747 A 10/1984 Pagel
4,604,014 A 8/1986 Frano
4,665,672 A 5/1987 Commins et al.
4,703,711 A 11/1987 Haynes
4,708,555 A 11/1987 Terry
4,720,223 A 1/1988 Neights et al.
4,729,703 A 3/1988 Sato
4,761,860 A 8/1988 Krauss
4,801,231 A 1/1989 Everman
4,812,096 A 3/1989 Peterson
4,875,314 A 10/1989 Boilen
4,887,948 A 12/1989 Calmettes
4,896,985 A 1/1990 Commins
4,909,012 A 3/1990 Thompson, Jr. et al.
4,919,122 A 4/1990 Kohlenbrenner
4,922,771 A 5/1990 Campbell
4,936,843 A 6/1990 Sohngen
4,954,032 A 9/1990 Morales
4,979,857 A 12/1990 Wing
5,015,132 A 5/1991 Turner et al.
5,081,811 A 1/1992 Sasaki
5,090,855 A 2/1992 Terry
5,168,681 A 12/1992 Ayrapetyan
5,180,268 A 1/1993 Richardson
5,197,176 A 3/1993 Reese
5,199,835 A 4/1993 Turner
5,207,543 A 5/1993 Kirma
5,228,250 A 7/1993 Kesselman
5,249,404 A 10/1993 Leek et al.
5,254,016 A 10/1993 Ganthier
5,265,326 A 11/1993 Scribner
5,308,184 A 5/1994 Bernard
5,316,319 A 5/1994 Suggs
5,340,258 A 8/1994 Simon
5,364,214 A 11/1994 Fazekas
5,365,715 A 11/1994 Steinmetz et al.
5,370,483 A 12/1994 Hood et al.
5,379,563 A 1/1995 Tinsley
5,386,748 A 2/1995 Kilgore
5,487,632 A 1/1996 Hood et al.
5,505,026 A 4/1996 Intilla
5,522,688 A 6/1996 Reh
5,535,561 A 7/1996 Schuyler
5,540,530 A 7/1996 Fazekas
5,570,549 A 11/1996 Lung et al.
5,582,496 A 12/1996 Ambrico et al.
5,606,839 A 3/1997 Baumann
5,704,572 A 1/1998 Vogel et al.
5,769,581 A 6/1998 Wallace et al.
5,815,999 A 10/1998 Williams
5,829,531 A 11/1998 Hebert et al.
5,839,321 A * 11/1998 Siemons ..... 74/441
5,885,034 A 3/1999 Fergusson
5,931,618 A 8/1999 Wallace et al.
5,979,130 A 11/1999 Gregg et al.
5,987,828 A 11/1999 Hardy
6,019,556 A 2/2000 Hess
6,068,250 A 5/2000 Hawkins et al.
6,120,723 A 9/2000 Butler
6,135,687 A 10/2000 Leek et al.
6,139,113 A 10/2000 Seliga
6,158,188 A 12/2000 Shahnazarian
6,161,350 A 12/2000 Espinosa
6,167,785 B1 1/2001 Penner
6,250,041 B1 6/2001 Seccombe
6,256,960 B1 7/2001 Babcock et al.
6,282,994 B1 9/2001 Wei
6,327,831 B1 12/2001 Leek
6,390,747 B1 5/2002 Commins
6,494,654 B2 12/2002 Espinosa
6,513,290 B2 2/2003 Leek
6,585,469 B2 7/2003 Commins
6,688,058 B2 2/2004 Espinosa
6,745,649 B1 6/2004 Liao
2001/0002529 A1 6/2001 Commins et al.
2001/0037611 A1 11/2001 Comett, Sr.
2002/0020137 A1 2/2002 Commins
2002/0092383 A1 7/2002 Nezigane
2006/0000318 A1 1/2006 Hsieh

FOREIGN PATENT DOCUMENTS

GB 383460 11/1932
GB 1099472 1/1968
GB 1384511 2/1975
JP 46-1521 1/1971
SU 706586 12/1979
SU 796498 1/1981

OTHER PUBLICATIONS

McGraw-Hill Book Company, Inc., "Product Engineering Design Manual" edited by Douglas C. Greenwood, (New York), copyright 1959, (Title and copyright page, pp. 90-97, 316-329).
Arthur B. Richardson, Declaration of Arthur B. Richardson, executed Dec. 21, 2002, p. 106.
Anchor Tiedown Systems, Inc., "Expansion Jack Washer," Anchor Tiedown System, Inc. Brochure (Mill Valley, CA and Burien, WA), consist of one page, printed one side (1999).
"Device Keeps Shear Walls Tight," p. 49-50.
"Expansion Jack Washer," (1999).

"Thru-Bolt Log Fastening System, Heritage Log Homes," (1999).
"Earthbound Seismis Holdown System Using The "Impasse Device"," Evaluation Report, ICBO Evaluation Service, Inc., (U.S. A.), p. 1-6 (Nov. 1, 1997).
Inquest Engineering, Manufacturers of the Earthbound System, Redefining the State of the Art in Seimic Holdown Technology (U.S. A.).
"The Impasse Devise," Inquest Engineering (U.S.A.), (1997).
"LocTite, Automatic Self-Locking Nuts," LocTite (U.S.A. (Oct. 1992).
"Auto Take-Up," Zone Four Engineered Seismic Solutions (U.S.A.), p. 1-4, (2000).
"AT Auto Take-Up," Zone Four Innovative Engineered Solutions (Friday Harbor, WA, U.S.A.), (2001).
"ATS-Components," Simpson Strong-Tie U.S.A.).
"Commins Design LLC," Acceptance Criteria for Shrinkage Compensating Devices and Similar Devices, Proposed ICBO Take-Up Devices Acceptrance Criteria, Draft 1, Dec. 9, 1999, Commins Design LLC (Friday Harbor, WA), total of 3 pages, (Nov. 2, 1999 and Dec. 9, 1999).
Commins Design LLC, "ICBO Evaluation Service Inc. Evaluation Report, ER-XXXX Dec. 10, 1999," Proposed, 1.0 Subject Commins Desing AT Automatic Take-Up Shrinkage Compensating Devices, Commins Design LLC (Friday Harbor, WA), total of 5 pages, (Dec. 10, 1999).
Commins Design LLC, "AT Auto Take-Up," Shearwall Shrinkage Compensator Solves the Loose Shearwall Problem, Commins Design LLC (Friday Harbor, WA), total of 1 page, (Jan. 3, 2000).
Commins Design LLC, "Commins Design LLC;" Our Solution to Wood Shrinkage Solves Shearwall Problems, Commins Design LLC (Friday Harbor, WA), tatal fo 2 pages, (Jan. 2000).
Commins, Alfred D., U.S. Appl. No. 60/156,04, titled "Shrinkage Compensator for Building Tiedowns;" filed Sep. 24, 1999.
Automatic Take-Up Device by Alfred D. Commins, dated Feb. 10, 1998 (5 pages).
Automatic Take-Up Device by Alfred D. Commins, dated Aug. 15, 1996 (7 pages).
Automatic Take-Up Device by Alfred D. Commins, dated Mar. 6, 1996 (3 pages).
Automatic Take-Up Device by Alfred D. Commins, dated Mar. 6, 1996 and Jan. 25, 1996 (5 pages).
Automatic Take-Up Device by Alfred D. Commins, dated Dec. 26, 1995 (3 pages).

* cited by examiner

AUTOMATIC TAKE-UP DEVICE WITH INTERNAL SPRING

This application is a continuation of application Ser. No. 09/729,491 filed on Dec. 3, 2000 now abandoned. The present invention relates to an expansion device. The device is adapted for maintaining the compression forces one work piece exerts on another. The present invention is inserted between two work pieces and is designed to expand if conditions cause the two to spread apart.

BACKGROUND

The present invention is particularly suited for use with tie-down systems used to anchor wood-framed buildings to their foundations. Many such systems use a rod or bolt that is anchored at its lower end to either a lower member of the building or directly to its foundation. The upper end of the bolt or rod is connected to a plate or bracket which, in turn, is connected to an upper portion of the building. The rod or bolt is usually connected to the bracket by means of a nut thread onto the bolt or rod that presses against the plate or bracket. The rod or bolt is placed in tension by tightening the nut against the plate or bracket that receives the rod or bolt.

For the rod or bolt to serve as an effective anchor for the building it is important that the rod remain in tension and, correspondingly, that the nut continue to compress the plate or bracket. However, a number of different factors can cause the nut to move away from the bolt, which causes the rod to lose its tension.

One such factor is wood shrinkage. Most lumber used in wood-frame construction has a relatively high water content when the building is constructed. However, once the envelope of the building is completed, the lumber is no longer exposed to the relatively humid outside air, and it begins to lose moisture which leads to shrinkage. A standard 2×4 can shrink by as much as 1/16" of an inch across its grain within the first two years that it is incorporated in a building.

A wide variety of methods have been proposed to maintain the tension in anchoring rods and bolts used in tie down systems for buildings. See, for example: U.S. Pat. No. 5,180,268, granted to Arthur B. Richardson on Jan. 12, 1993; U.S. Pat. No. 5,364,214, granted to Scott Fazekas on Nov. 15, 1994; or U.S. Pat. No. 5,522,688, granted to Carter K. Reh on Jun. 4, 1996. These devices are interposed between two work members and expand as the two members separate, maintaining the connection or contact between them. These devices are designed to expand without reversing or contracting once they are installed.

U.S. Pat. No. 5,081,811, granted to Kensuke Sasaki on Jan. 21, 1992 (Sasaki '811) takes a different approach. Sasaki '811 uses a special one-way sliding nut that is attached to the wood member upon which it bears. As the building shrinks or settles, the Sasaki nut travels with the building down on the rod by means of its one-way sliding feature.

Another approach is taught by U.S. Pat. No. 4,812,096. This patent was granted to Peter O. Peterson on Mar. 14, 1989. In this method, the tension rods are pulled into connecting brackets as the building shrinks and settles, such that the over-all length of the tie-down system is reduced.

The present invention represents an improvement over the prior art methods. The present invention provides a novel expansion device that is fully adjustable, has protective members for shielding the working mechanisms of the device from the elements and dirt and grime, provides a rigid force transmitting mechanism, and has built in redundancy in the expansion mechanism so that the device is less likely to fail.

BRIEF SUMMARY OF THE INVENTION

The present invention consists of a connection, having an anchored, elongated tension member, a fastening member attached to the elongated tension member, a resisting member that receives the elongated tension member and an expansion device that receives the elongated tension member there through and is compressively loaded between the fastening member and the resisting member by operation of the fastening member on the elongated tension member.

The expansion device consists of a surrounding sleeve having two ends, and a central aperture through which the elongated tension member is inserted. A portion of the central aperture is formed as a substantially cylindrical inner surface and at least a portion of the cylindrical inner surface is formed with a thread. First and second bearing members are received in the central aperture of the surrounding sleeve and operatively connected to the surrounding sleeve. The first and second bearing members also have apertures through which the elongated tension member is inserted. At least one of the bearing members has a cylindrical outer surface formed with a thread that mates with the thread of the cylindrical inner surface of the surrounding sleeve and is connected to the surrounding sleeve only by the mating attachment of the thread on the cylindrical outer surface with the thread of the surrounding sleeve. This bearing member can rotate in relation to the surrounding sleeve. The first and second bearing members are formed with outer axial ends that protrude out of the surrounding sleeve with the outer axial end of the first bearing member contacting the fastening member, and the outer axial end of the second bearing member contacting the resisting member. A torsion spring connects the first and second bearing members and is located within the surrounding sleeve. The torsion spring biases the first and second members in opposite rotational directions such that at least one of the bearing members is forced to rotate along said thread of said surrounding sleeve away from the other bearing member and out of the surrounding sleeve.

It is an object of the present invention to provide an expansion device, for a tie down connection system that operates to assure continued tightness and rigidity in a connection system.

It is a further object of the present invention to provide a expansion device that is fully adjustable. In the present invention the rotating bearing member or members ride along a helical thread. There are no steps in the thread, thus any separation of the two working members making up the connection, no matter how small, that is within the expansion range of the device, can be accommodated.

It is a further object to provide a expansion device that resists contracting or shrinking under compression loads such as those exerted on a tie-down system during a large seismic event. Mated threaded connections are highly resistant to movement unless some rotational force is introduced, and the torsion spring resists rotational forces that would contract the device.

It is a further object of the invention to provide an expansion device that is relatively maintenance free and whose working parts are relatively protected from water, debris and dust. In the preferred embodiment of the present invention, the torsion spring is almost completely sealed from the outside by the combination of the surrounding sleeve, the first and second cylindrical bearing members, the sizing sleeve, and the o-rings.

It is a further object of the present invention to provide an expansion member that is strong and can adequately transmit forces from one working member at one end of the device to another working member at the other end of the device. The preferred embodiment uses two threaded cylindrical bearing members that mate with the thread of the surrounding sleeve. The threaded connection between the components creates a strong mechanical connection that is resistant to shaking and vibration.

It is a further object of the present invention to provide a expansion device that has built-in redundancy in its expansion mechanism so that the device is less likely to fail. In the preferred embodiment of the present invention, the first and second cylindrical members are both driven by the same torsion spring. Should one of the cylindrical bearing members become jammed and unable to rotate on the threads of the surrounding sleeve, the other cylindrical member will continue to rotate in response to the forces generated by the spring.

It is a further object of the present invention to provide a compact expansion device that can be used with tie down brackets that can be placed within 2×4-framed walls. This benefit is accomplished in part by the use of the threaded connection between the cylindrical bearing members and the sizing sleeve. The threads of the cylindrical bearing member create an adequate bearing and force transmission surface while providing the device with a small footprint.

It is a further object of the invention to provide a device that is easily installed and incorporated into present building practices. The present invention is easily slipped over a rod or bolt before a nut and washer are tightened down.

BRIEF DESCRIPTION OF THE DRAWINGS

FIG. 1 also shows a nut, a washer and a locking clip.

DESCRIPTION OF THE PREFERRED EMBODIMENT

Figure 4A:
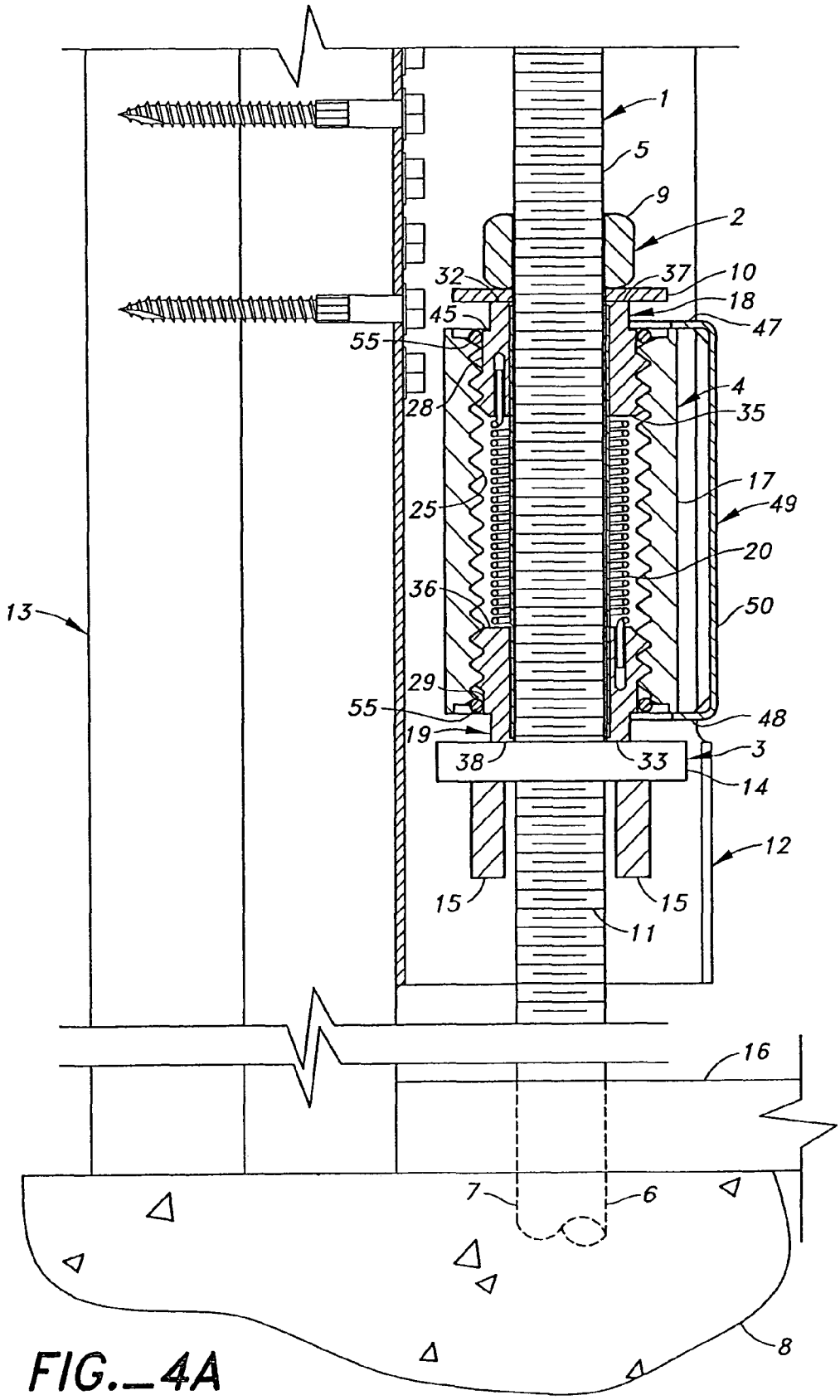
FIG. 4A shows a connection made according to the present invention. The expansion device is shown in cross section. The locking clip is shown inserted onto the expansion device. The expansion device receives an anchor bolt embedded in a concrete foundation. A nut, shown in cross section, is threaded onto the anchor bolt. The nut bears on a washer which bears upon the expansion device. The expansion device bears upon another washer that receives the anchor bolt there through. The washer bears upon the crossbars of a holdown 12. The crossbars are shown in cross-section. The holdown 12 is shown attached to a vertically disposed structural member by means of threaded fasteners driven through the back member of the holdown 12 and into the structural member.
Figure 4B:
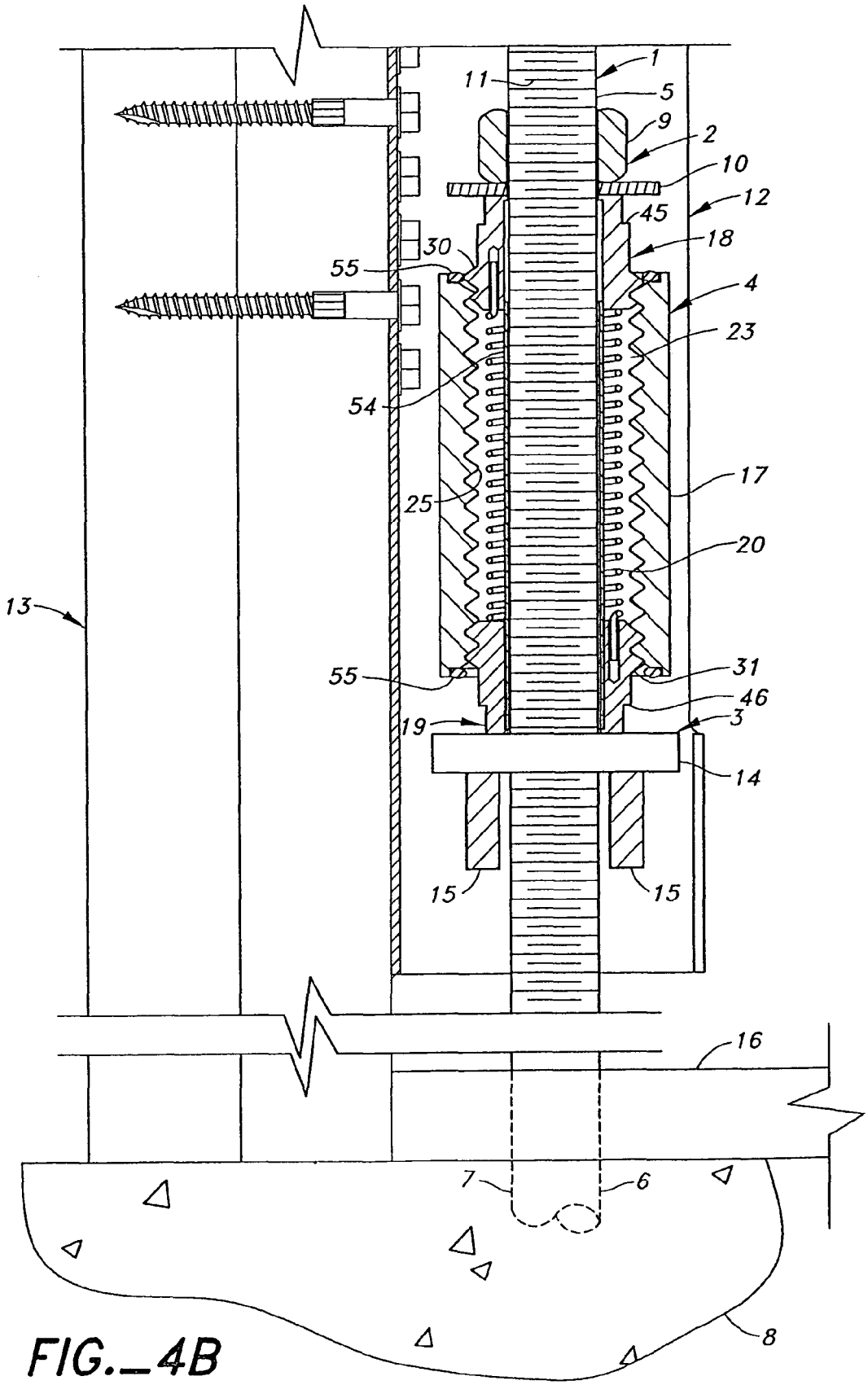
FIG. 4B shows a connection made according to the present invention. It is similar to FIG. 4A except that the locking clip has been removed and the device is shown in its expanded position.
Figure 5A:
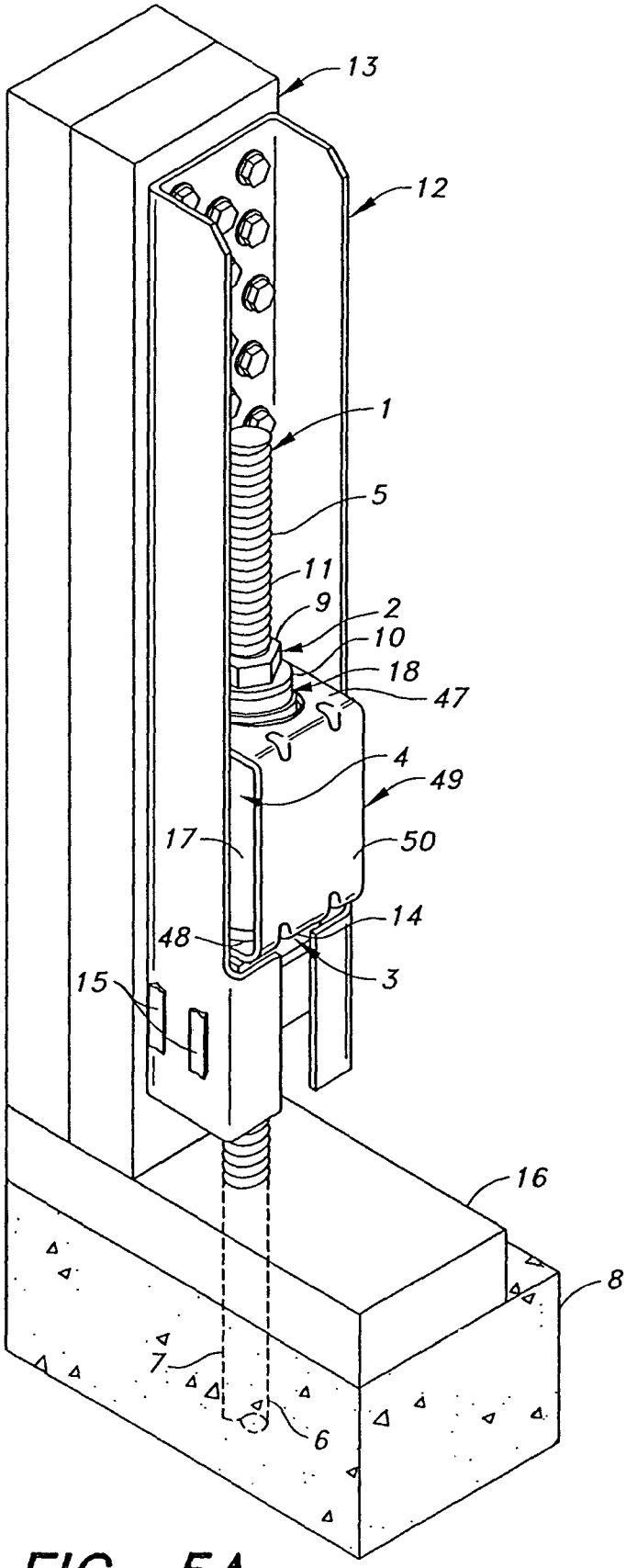
FIG. 5A is perspective view of a connection made according to the present invention. The locking clip is shown attached to the device.

As shown in FIGS. 4A, 4B and 5A, the present invention relates to a connection between an elongated tension member 1, a fastening member 2 attached to the elongated tension member 1, a resisting member 3 that receives the elongated tension member 1 and an expansion device 4 disposed between the fastening member 2 and the elongated tension member 1.

The elongated tension member 1 has first and second ends 5 and 6 with the second end 6 being anchored. For example, said elongated tension member 1 could be a threaded anchor bolt 7 with its second or lower end 6 embedded in the concrete foundation 8 of a building. Preferred anchor bolts 7 for embedment in a concrete foundation 8 to be used in the present connection are SSTB anchor bolts.

The fastening member 2 is attached to the first end 5 of the elongated tension member 1. The fastening member 2 need not be attached at any particular location on the elongated tension member 1, reference is made to the first and second ends 5 and 6 of the elongated tension member 1 merely to designate that the anchoring of the elongated tension member 1 and the attachment of the fastening member 2 to the elongated tension member 1 do not occur at the same place on the tension member 1. The preferred fastening member 2 is a threaded nut 9 and washer 10 combination, with the thread of the nut 9 mating with the thread 11 of the elongated tension member 1.

A resisting member 3 also receives the elongated tension member 1. The elongated tension member 1 may pass through an opening or notch in the resisting member 3 or may be enveloped by the resisting member 3 in some other manner. The resisting member 3 is disposed below the fastening member 2 on the tension member 1. The fact that the fastening member 2 is described as being located below the fastening member 2 does not require that the elongated tension member 1 be vertically oriented. The resisting member 3 may be a plate or bracket, or preferably part of a holdown 12 that is used in a tie-down system for a building. As is shown in FIGS. 4A, 4B and 5A the resisting member 3 is part of a holdown bracket 12 attached to vertical member or post 13 in a building.

The expansion device 4 of the present invention also receives the elongated tension member 1 and is disposed between the fastening member 2 and the resisting member 3, contacting both. The expansion device 4 is compressively loaded between said fastening member 2 and the resisting member 3 by operation of the fastening member 2 on the elongated tension member 1. In the preferred embodiment, as is shown in FIGS. 4A, 4B and 5A, a nut 9 and washer 10 are tightened onto an anchor bolt 7 embedded in a foundation 8. The nut 9 and washer 10 compress the expansion device 4 against the resisting member 3 which in this case is a washer 14 supported by the crossbars 15 of a holdown 12 attached to a post 13 in the building. The post 13 resists this compression load by bearing on the foundation 8 or, as is shown in FIG. 5A, a mudsill 16 resting on the foundation 8.

In its most basic form, the expansion device 4 has a surrounding sleeve 17, first and second bearing members 18 and 19 connected to the surrounding sleeve 17 and a torsion spring 20 that can rotate at least one of the bearing members 18 or 19 in the surrounding sleeve 17, which causes said rotatable bearing member 18 or 19 to travel further out of the surrounding sleeve 17, expanding the length of the device 4.

The surrounding sleeve 17 of the expansion device 4 has two ends 21 and 22, and a central aperture 23 through which the elongated tension member 1 is inserted. A portion of the central aperture 23 is formed as a substantially cylindrical inner surface 24 and at least a portion of the cylindrical inner surface 24 is formed with a thread 25. Preferably, substantially all of the central aperture 23 is formed as a cylindrical inner surface 24 having a thread 25 along substantially its entire length.

First and second bearing members 18 and 19 are received in the central aperture 23 of the surrounding sleeve 17 and operatively connected to the surrounding sleeve 17. The first and second bearing members 18 and 19 also have apertures 26 and 27 through which the elongated tension member 1 is inserted. For operation of the invention, at least one of the bearing members 18 or 19 has a cylindrical outer surface 28 or 29 formed with a thread 30 or 31 that mates with the thread 25 of the cylindrical inner surface 24 of the surrounding sleeve 17 and is connected to the surrounding sleeve 17 only by the mating attachment of the thread 30 or 31 on the cylindrical outer surface 28 or 29 with the thread 25 of the surrounding sleeve 17. This allows this bearing member 18 or 19 to rotate in relation to the surrounding sleeve 17.

The first and second bearing members 18 and 19 are also formed with outer axial ends 32 and 33 that protrude out of the surrounding sleeve 17. The outer axial end 32 of the first bearing member 18 contacts the fastening member 2, and the outer axial end 33 of the second bearing member 19 contacts the resisting member 3.

A torsion spring 20 connects the first and second bearing members 18 and 19. The torsion spring 20 biases the first and second bearing members 18 and 19 in opposite rotational directions such that at least one of the bearing members 18 or 19 is forced to rotate along the thread 25 of the surrounding sleeve 17 away from the other bearing member 18 or 19 and out of the surrounding sleeve 17, if the rotational force generated by the torsion spring 20 is greater than the compression forces on the expansion device 4. The torsion spring 20 is disposed within the surrounding sleeve 17.

Figure 1:
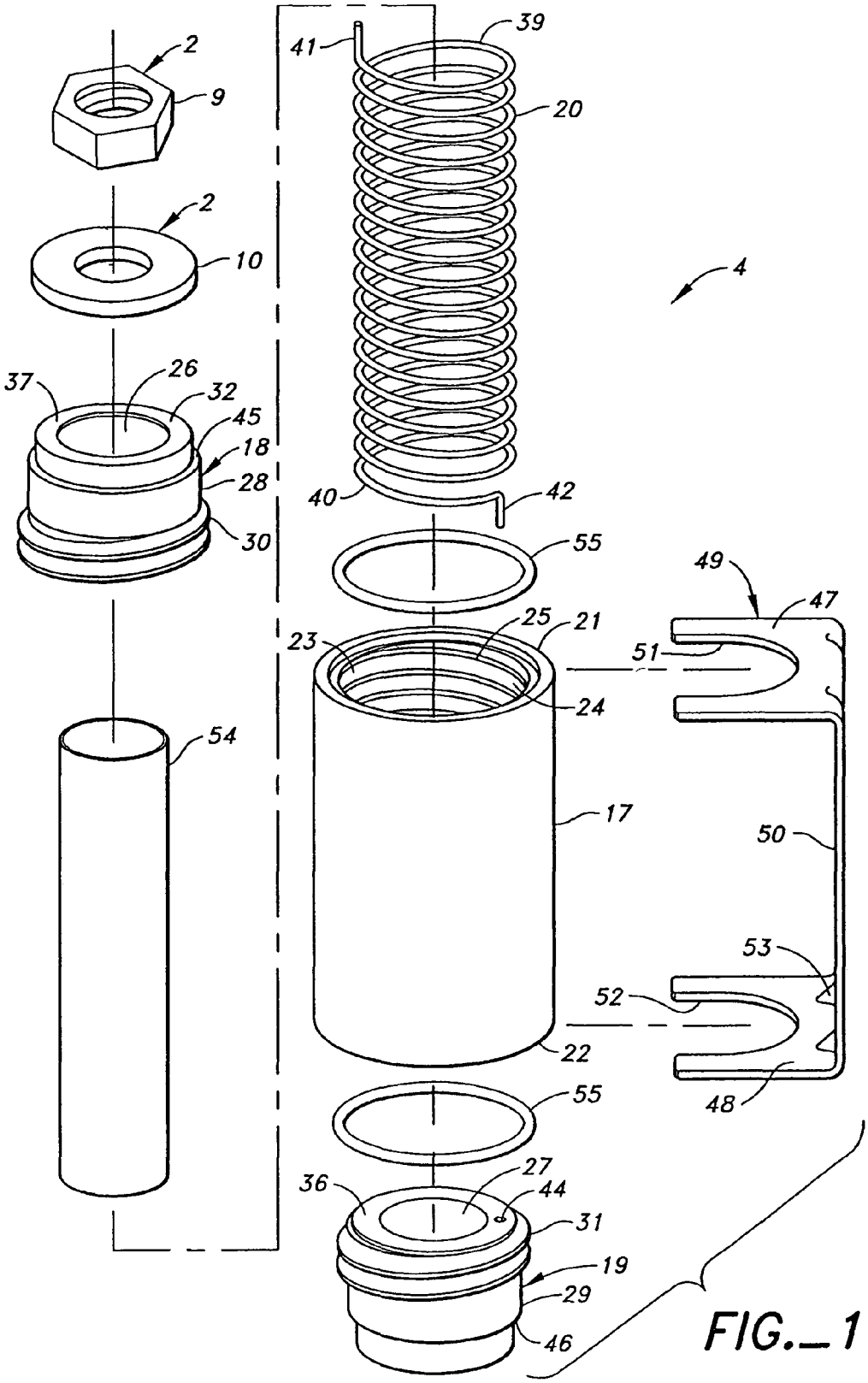
FIG. 1 is an exploded view of an expansion device of the present invention.
Figure 2A:
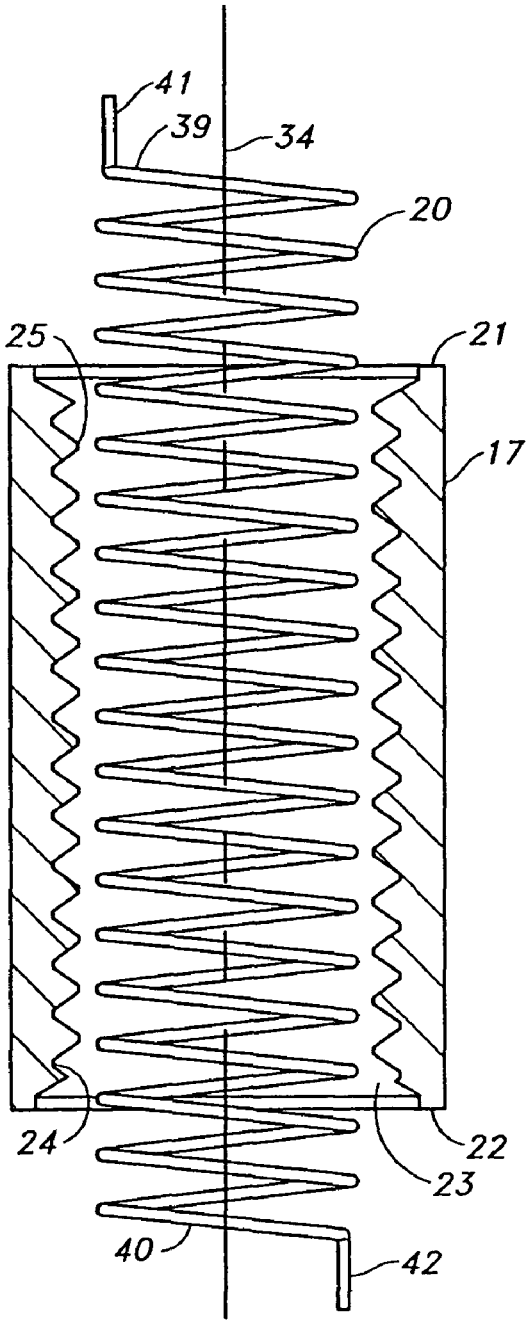
FIG. 2A is a cross-sectional side view of the surrounding sleeve of the expansion device of the present invention. The torsion spring is shown inserted into the surrounding sleeve. The torsion spring is shown at its rest position. For clarity, the threads on the surrounding sleeve are shown only in cross-section. This drawing convention is used in all of the side views of the device.
Figure 2B:
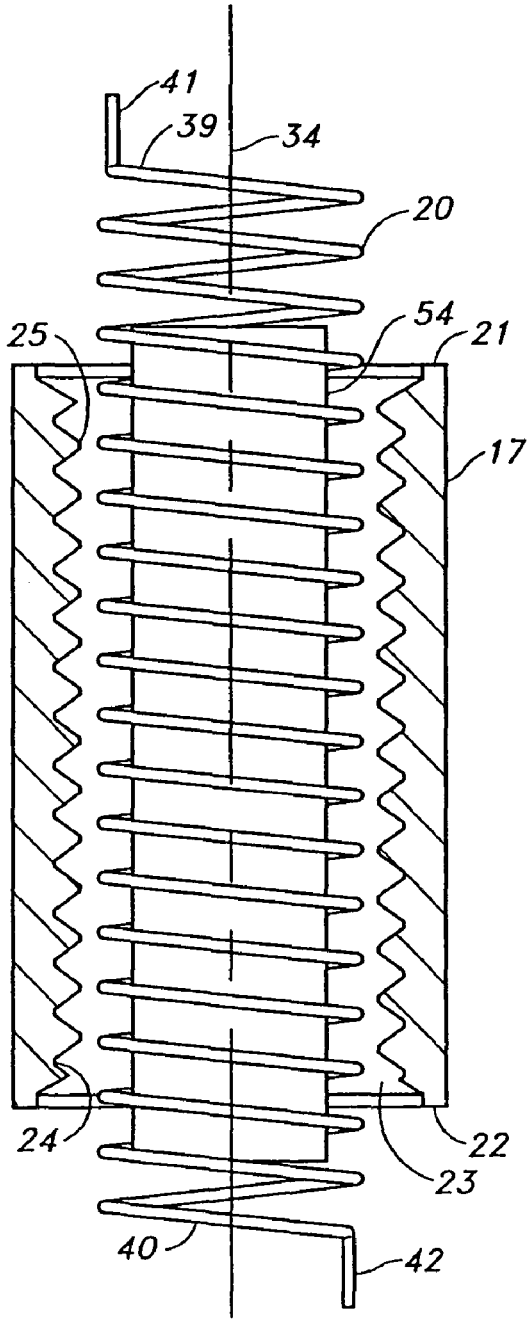
FIG. 2B is a cross-sectional side view of the surrounding sleeve. The torsion spring is shown inserted into the surrounding sleeve over a sizing sleeve.
Figure 2C:
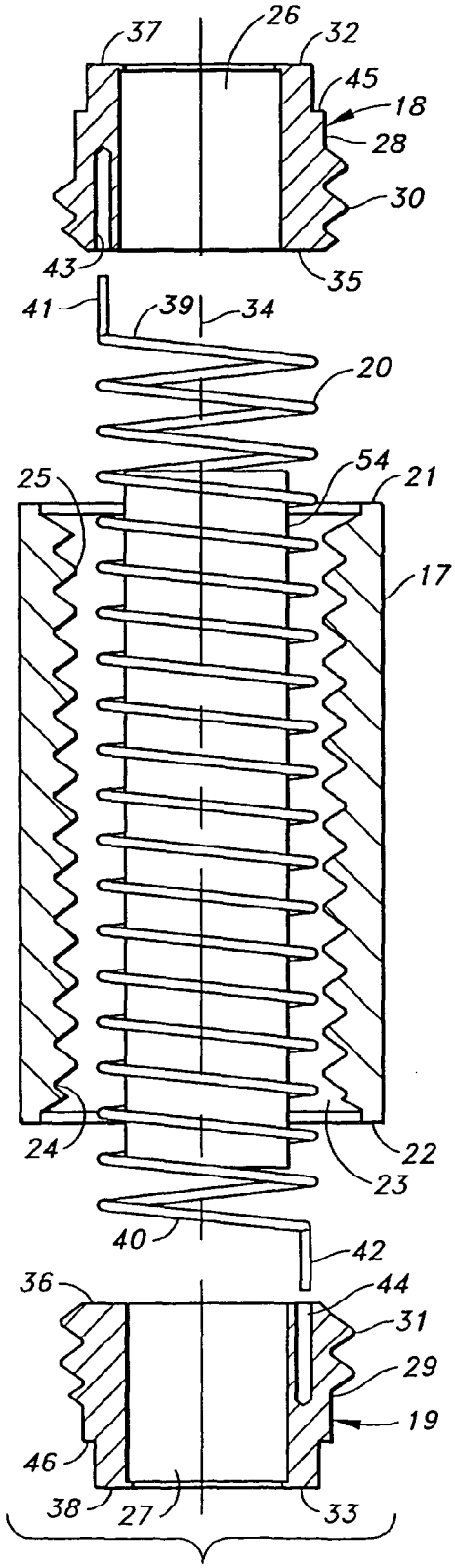
FIG. 2C is a cross-sectional side view of the surrounding sleeve. The torsion spring is shown inserted into the surrounding sleeve over a sizing sleeve. First and second cylindrical bearing members are shown in cross-section. They are disposed above and below the surrounding sleeve and are ready to be inserted onto the tangs of the torsion spring.
Figure 2D:
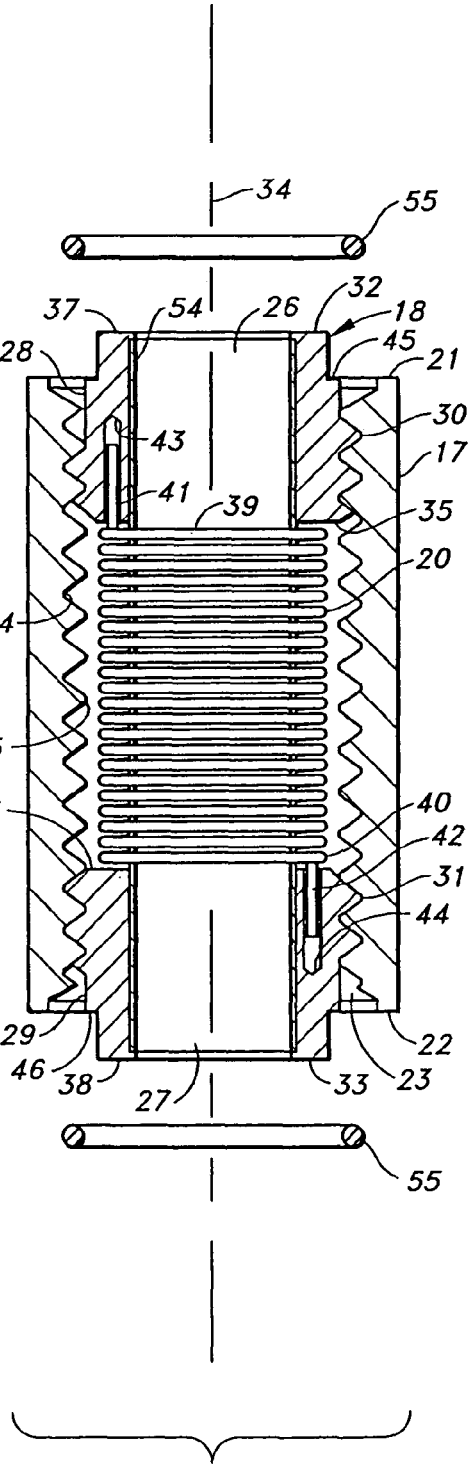
FIG. 2D is a cross-sectional side view of the surrounding sleeve. The torsion spring is shown inserted into the surrounding sleeve over a sizing sleeve. The sizing sleeve is shown in cross-section. The first and second cylindrical bearing members are shown in cross-section. They are shown threaded into the surrounding sleeve in the cocked and ready position. The means by which the first and second bearing members are held in the ready position are not shown.

As is shown in FIGS. 1 and 2D, in the preferred embodiment, the expansion device 4 has first and second bearing members 18 and 19. Preferably, the first and second bearing members 18 and 19 are substantially identical and generally cylindrical members. In the preferred embodiment, each cylindrical bearing member 18 or 19 has a central aperture 26 or 27 there through. Preferably each cylindrical bearing member 18 or 19 spins on the central axis 34 of the expansion device 4. The cylindrical bearing members 18 and 19 are assembled in opposed axial alignment within a surrounding sleeve 17, such that the central apertures 26 and 27 of the cylindrical bearing members 18 and 19 are in alignment.

As is shown in FIGS. 2C and 2D, in relation to the surrounding sleeve 17, the cylindrical bearing members 18 and 19 have outer axial ends 32 and 33 and inner axial ends 35 and 36. The inner axial ends 35 and 36 of the cylindrical bearing members 18 and 19 face each other within the surrounding sleeve 17. The outer axial ends 32 and 33 have substantially planar surfaces 37 and 38 which are, preferably, orthogonal to the central or longitudinal axis 34 of the expansion device 4

As is shown in FIGS. 1, 2C and 2D, in the preferred embodiment, the first and second cylindrical bearing members 18 and 19 are each formed with a thread 30 or 31 on their outer surface 28 or 29. These threads 30 and 31 mate with an inner thread 25 on the surrounding sleeve 17, such that the cylindrical bearing members 18 and 19 can travel within the surrounding sleeve 17 by being rotated. In the preferred embodiment, the entire inner surface 24 of the surrounding sleeve 17 is formed with a single thread 25 of uniform pitch. Also, in the preferred embodiment, the only connection between the surrounding sleeve 17 and the first and second cylindrical bearing members 18 and 19 is by means of their respective threaded surfaces 24, 28 and 29. Thus, each cylindrical bearing member 18 or 19 can travel freely along the inner thread 25 of the surrounding sleeve 17.

Figure 3A:
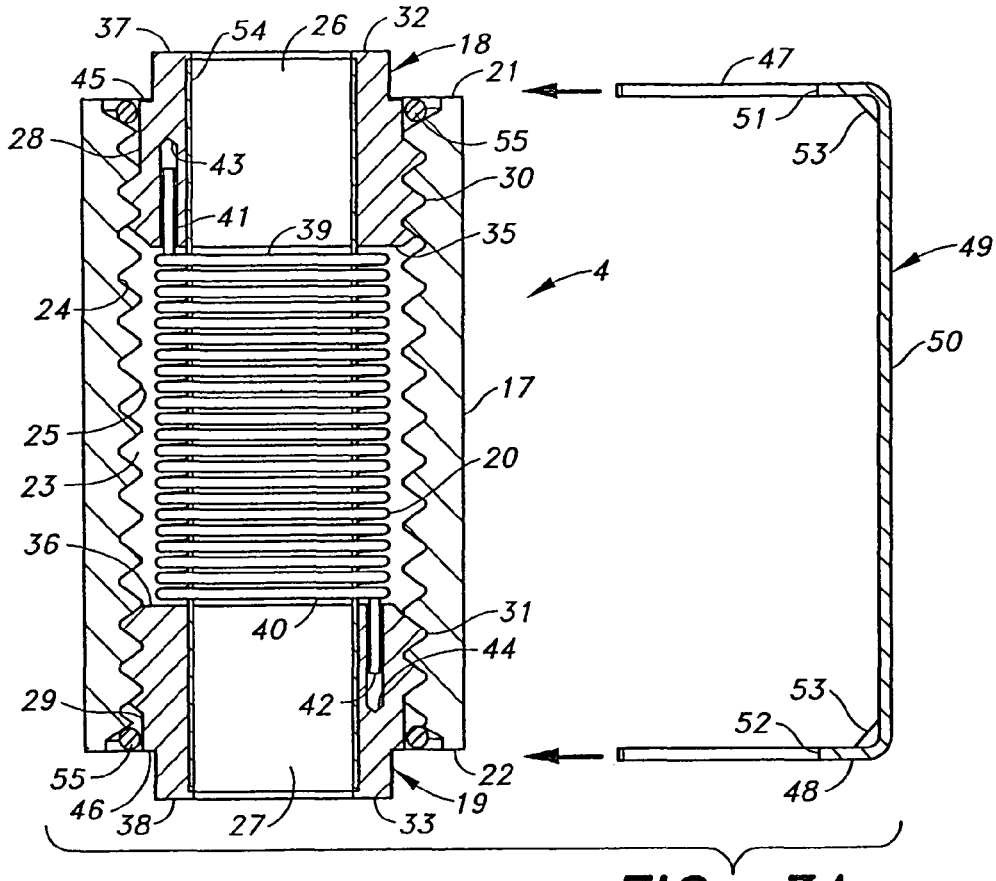
FIG. 3A is a view similar to FIG. 2D, except that the locking clip is shown in cross-section ready to be inserted onto the expansion device to hold the first and second cylindrical bearing members in the ready position.

In the preferred embodiment, the expansion or lengthening of the device 4 along its central axis 34 is accomplished by the movement of both the first and second cylindrical bearing members 18 and 19 in the surrounding sleeve 17. When the expansion device 4 is first installed, the first and second cylindrical bearing members 18 and 19 are threaded into the surrounding sleeve 17 from both ends 21 and 22 such that their inner axial surfaces 35 and 36 lie relatively close to each other and their outer axial surfaces 32 and 33 protrude only slightly from the ends of the surrounding sleeve 17. See FIGS. 2D and 3A. By rotating the cylindrical bearing members 18 and 19 in opposite directions, they are turned either farther into the surrounding sleeve 17 and closer to each other or out of the surrounding sleeve 17 and away from each other. Operation of the device 4 is accomplished by turning the first and second cylindrical members 18 and 19 in a manner that causes them to move away from each other such that their outer axial surfaces 32 and 33 protrude farther out of the surrounding sleeve 17, effectively lengthening or expanding the device 4. See FIG. 4B.

The pitch of the thread 25 of the surrounding sleeve 17 and the threads 30 and 31 of the first and second cylindrical members 18 and 19 is preferably optimized such that any rotation of the cylindrical bearing members 18 and 19 results in an appreciable enlargement of the space taken up by the device 4, while at the same time maintaining the ability of the expansion device 4 to resist contracting under design loads.

As is shown in FIGS. 1, 2A, 2B and 2C, a torsion spring 20 is also received in the surrounding sleeve 17. The torsion spring 20 connects the two cylindrical bearing members 18 and 19. See FIGS. 2C and 2D. The torsion spring 20 is formed with first and second ends 39 and 40. Each end 39 or 40 of the torsion spring 20 is connected to a cylindrical bearing member 18 or 19. See FIG. 2D and FIG. 9. Preferably, both ends 39 and 40 of the torsion spring 20 are formed with tangs 41 and 42, and each tang either 41 or 42 is received within a bore 43 or 44 in each of the cylindrical bearing members 18 or 19. The torsion spring 20, when wound, serves as a resilient torsion member, rotating the cylindrical bearing members 18 and 19 in opposite directions and causing them to travel away from each other on the thread 25 of the surrounding sleeve 17.

Figure 3B:
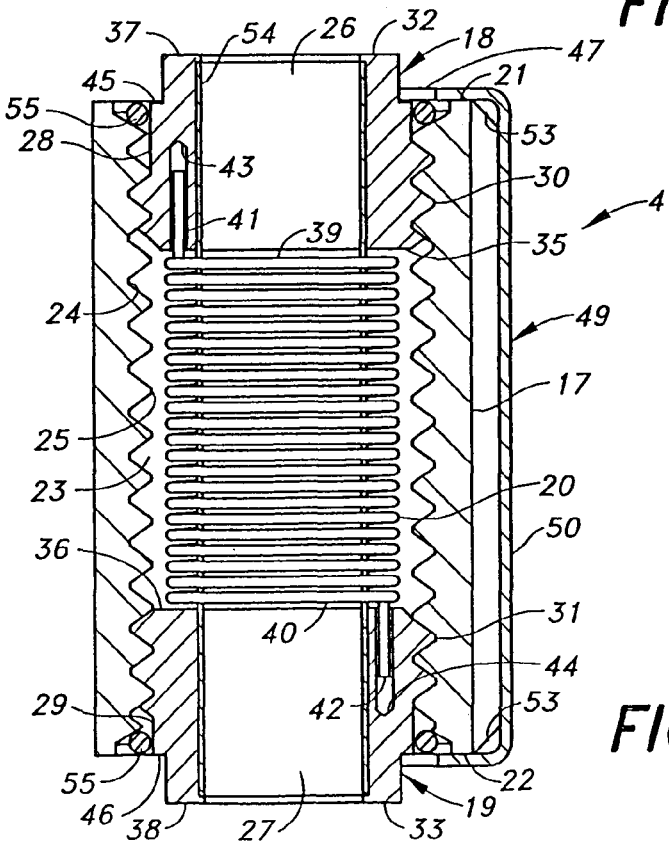
FIG. 3B is a view similar to FIGS. 2D and 3A, except that the locking clip has been inserted over the expansion device to hold it in its ready position. The flanges of the locking clip engage the shoulders of the first and second cylindrical bearing members. The shoulders are aligned with the end surfaces of the surrounding sleeve.

As is shown in FIG. 1, in the preferred embodiment, each cylindrical bearing member 18 or 19 is formed with an annular shoulder 45 or 46 near its outer axial end 32 or 33. These shoulders 45 and 46 are designed to bear upon the flanges 47 and 48 of a locking clip 49. See FIG. 3B.

The preferred locking clip 49 consists of a central body 50 from which two flanges 47 and 48 are bent. See FIGS. 3A, 3B, 5A and 5B. To conform to the preferred shape of the expansion device 4, the flanges 47 and 48 lie parallel to each other. The flanges 47 and 48 are each provided with a notch 51 and 52. Preferably, each notch 51 or 52 has an arced inner shape that corresponds in curvature to the to the outer diameter of the first or second cylindrical bearing members 18 or 19 between their outer axial ends 32 or 33 and their annular shoulders 45 or 46.

The locking clip 49 holds the expansion device 4 in a pre-installation, cocked position. The locking clip 49 is releasably attached to the expansion device 4. When engaged with the expansion device 4, the locking clip 49 holds the first and second bearing members 18 and 19 so as to prevent them from rotating under the influence of the torsion spring 20 and causing the device 4 to expand. This facilitates installation of the device 4, and ensures that the maximum expansion capabilities of the device 4 are available.

The locking clip 49 is preferably made from sheet metal. Preferably, strengthening gussets 53 are provided at the bends between the flanges 47 and 48 and the central body 50 of the locking clip 49. See FIGS. 1 and 3A.

As is shown in FIGS. 1 and 2B, in the preferred embodiment, a sizing sleeve 54 is used with the expansion device 4. The sizing sleeve 54 is a cylinder, having a central bore along its longitudinal axis. The sizing sleeve 54 is inserted into the expansion device 4 with its longitudinal axis in alignment with the longitudinal axis 34 of the expansion device 4. The sizing sleeve 54 is received within the surrounding sleeve 17 with the torsion spring 20 between the sizing sleeve 54 and the surrounding sleeve 17. The sizing sleeve 54 is also preferably received in the central apertures 26 and 27 of the first and second cylindrical bearing members 18 and 19. Different sized sizing sleeves 54 are designed to be used with different sized tension members 1 or rods. All the different sized sizing sleeves 54 have the same outer diameter, but the diameter of the central bore varies to fit various sized rods 1 or bolts received within the sizing sleeve 54. It is desirable to create a close fit between the sizing sleeve 54 and the bolt 1 or rod to create a more rigid system.

As is shown in FIG. 1, the preferred embodiment the expansion device 4 is also provided with seals or O-ring 55 at both ends 21 and 22 of the surrounding sleeve 17 to protect the inner thread 25 of the surrounding sleeve 17.

The surrounding sleeve 17, in combination with the cylindrical bearing members 18 and 19, the sizing sleeve 54, and O-rings 55, serves as a protective housing for the torsion spring 20 of the expansion device 4. During construction of a building containing the expansion device 4, the device could be exposed to rain, dust and knocks.

The expansion device 4 is shown at is maximum useful expansion in FIG. 4B. The expansion device 4 provides infinite adjustment within its range of expansion. The inventors have found that configuring the device to expand by 1" is an appropriate amount for most construction applications.

Since both cylindrical bearing members 18 and 19 rotate on a threaded member separate from themselves—the surrounding sleeve 17—each contributes equally to the expansion of the device 4. Further, if rotation of one of them is prevented for any reason, the other is still available to perform the work of both.

Figure 5B:
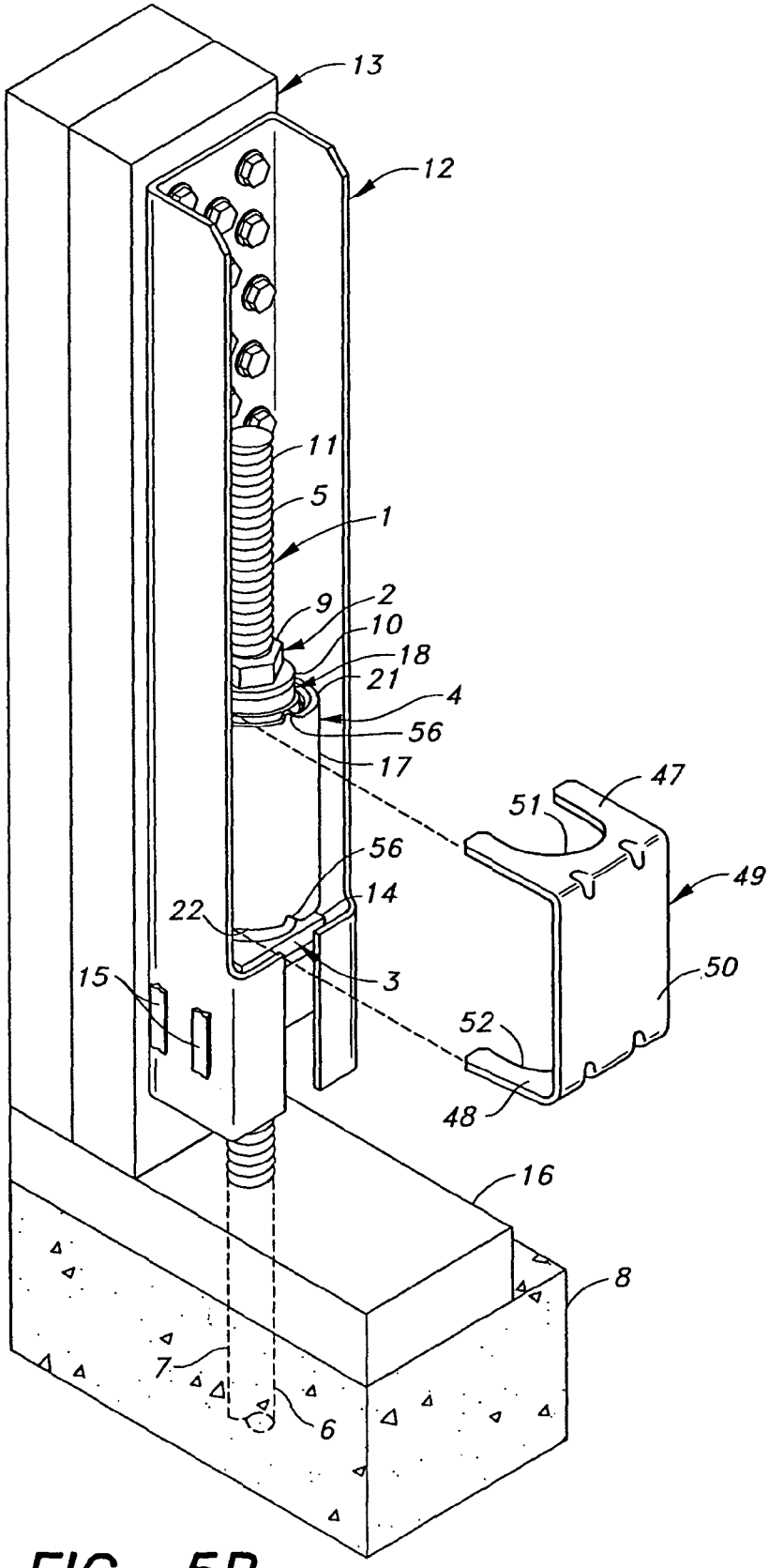
FIG. 5B is perspective view of a connection made according to the present invention. The locking clip is shown, having been removed from the device.
Figure 6A:
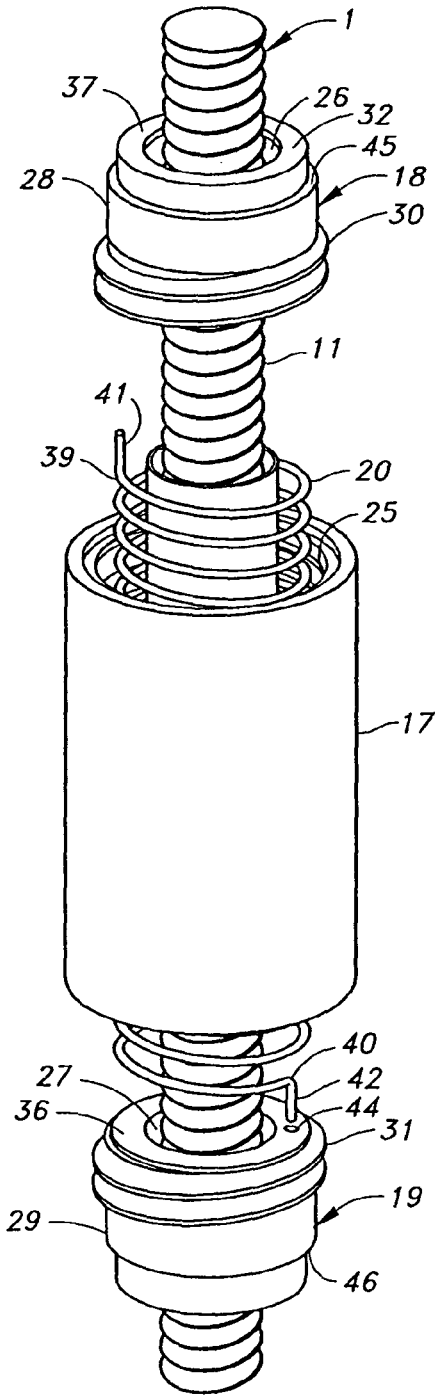
FIG. 6A is an exploded perspective view of the parts of the expansion device inserted over a tension member. The means by which the expansion device retains its position on the tension member are not shown.
Figure 6B:
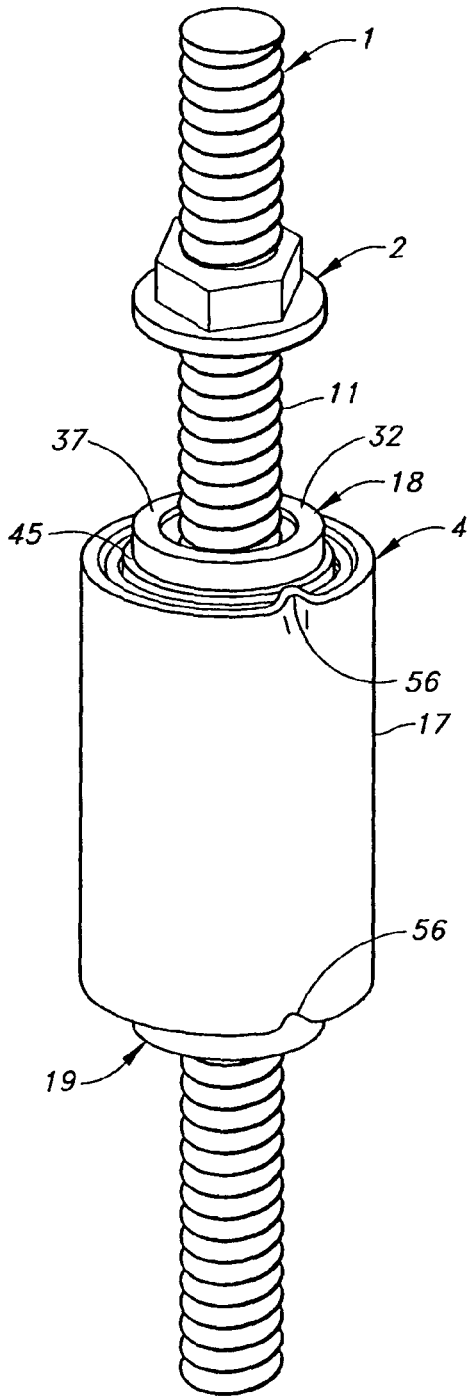
FIG. 6B is a perspective view of the expansion device as it would appear in its ready position. The means by which the expansion device is held in its ready position are not shown. The means by which the expansion device retains its position on the tension member are not shown. A nut and washer are shown threaded onto the tension member above the expansion device.
Figure 6C:
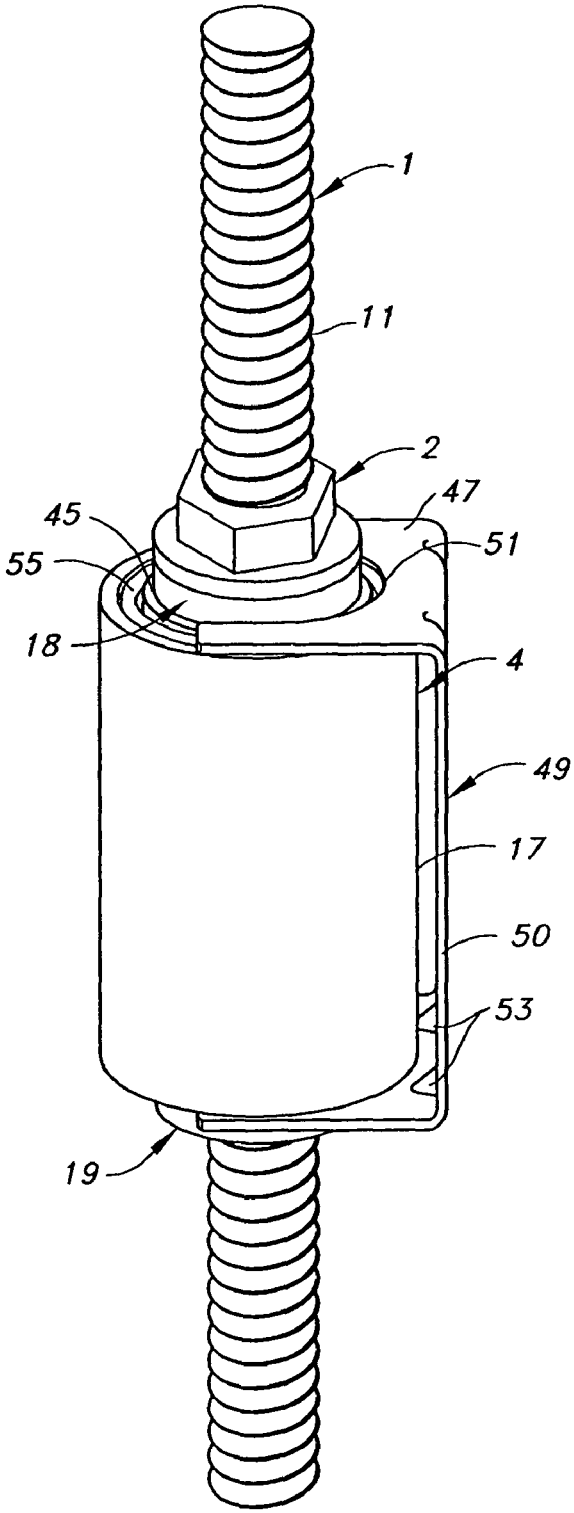
FIG. 6C is a perspective view of the expansion device as it would appear in its ready position with the locking clip attached. The means by which the expansion device retains its position on the tension member are not shown.

As is shown in FIGS. 5B and 6B, the thread of the surrounding sleeve 17 is preferably coined so as to serve as a stop for the cylindrical bearing members 18 and 19. This coining 56 serves to stop the cylindrical bearing members 18 and 19 from rotating all the way out of the surrounding sleeve 17.

Figure 7:
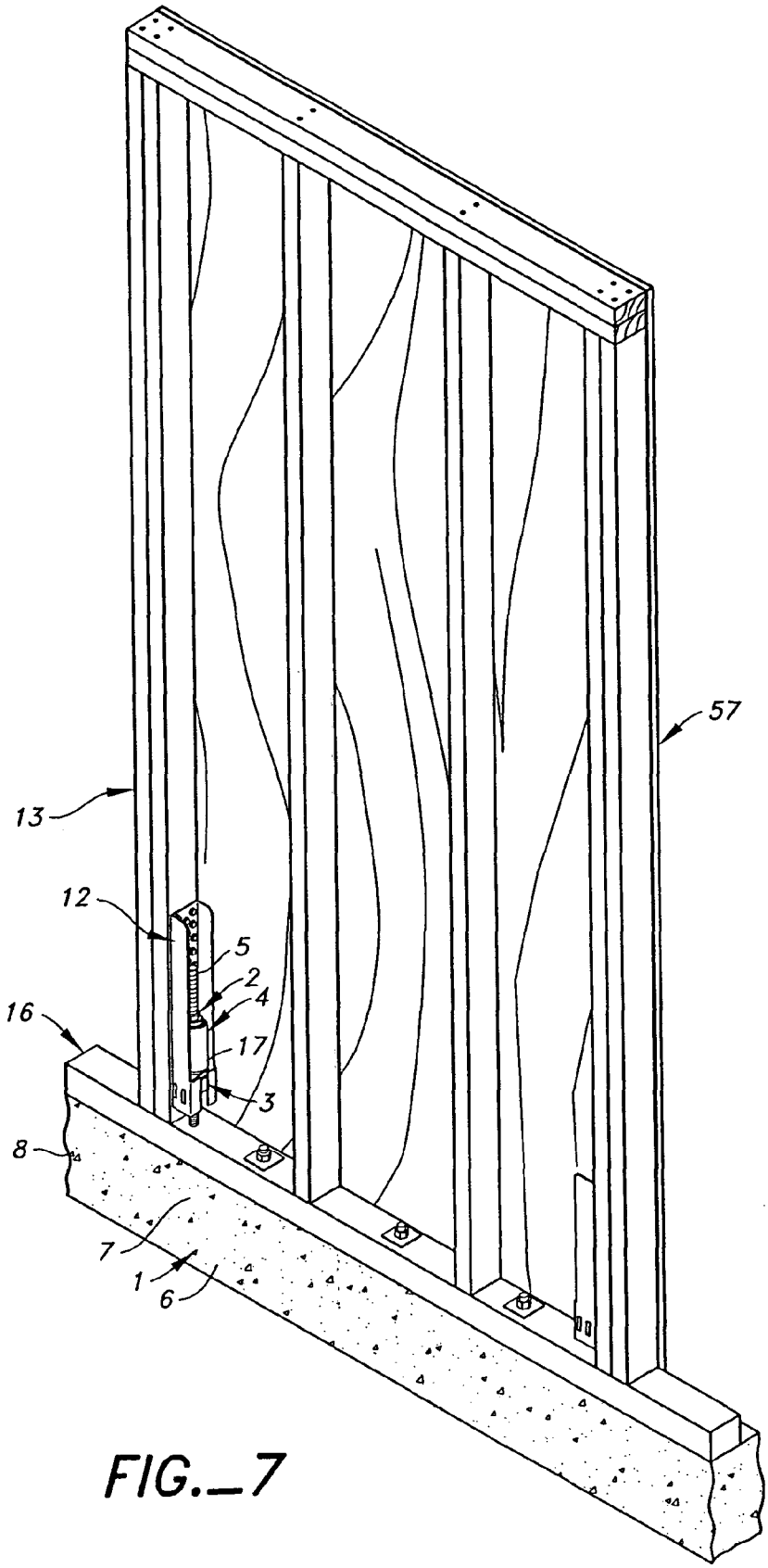
FIG. 7 is a perspective view of a shearwall attached to a foundation, showing the typical environment in which the connection of the present invention is used.

FIG. 7 illustrates a typical tie down installation for the wooden shear wall 57 of a building. The shear wall rests on a concrete foundation 8. An anchor bolt 7 is shown protruding from the top surface of the foundation 8. The anchor bolt 7 extends upwardly through the mudsill 13 of the wall 57. A holdown 12 is shown connected to the end chord or vertical member 13 of the shear wall 57. The expansion device 4 of the present application need not be used in vertical applications. The device could be used horizontally in continuity ties in roofs and other similar applications.

Figure 6D:
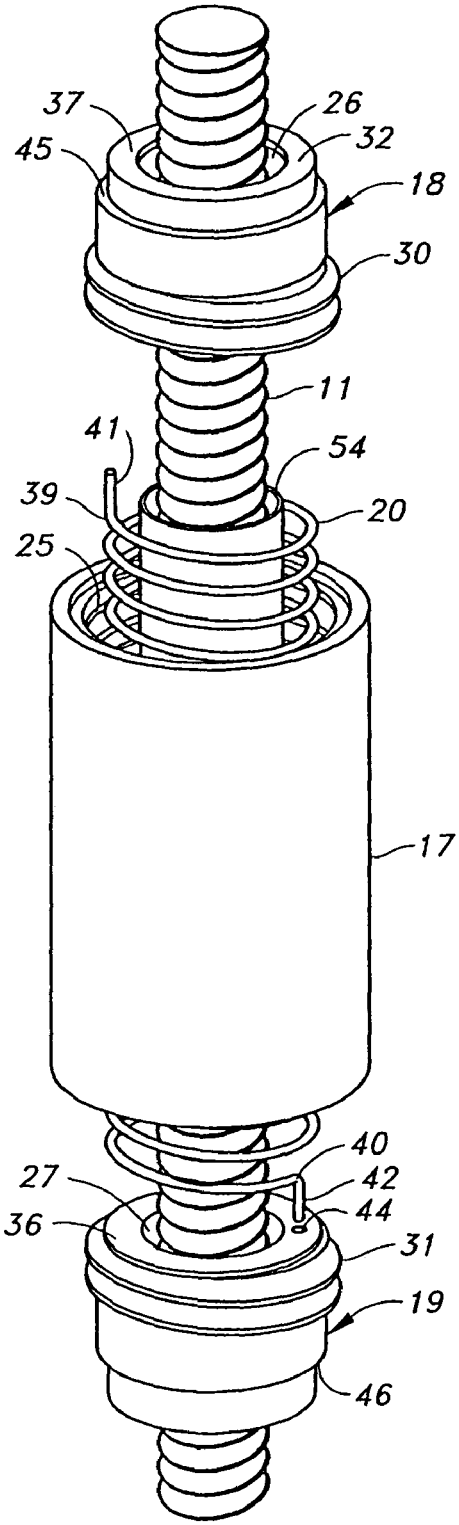
FIG. 6D is a view similar to FIG. 6A. It is an exploded perspective view of the parts of the expansion device inserted over a tension member. The means by which the expansion device retains its position on the tension member are not shown. This view differs from FIG. 6A in that the threads of the cylindrical members and the surrounding sleeve are oppositely threaded.

FIG. 6D shows the preferred direction of the thread 25 of the surrounding sleeve 17 and cylindrical bearing members 18 and 19 in relation to the thread 11 of the tension rod 1 of the preferred embodiment. It is preferable that the cylindrical bearing members 18 and 19 are threaded and driven by the torsion spring 20 in such a manner that if any of their rotational motion is translated to the nut 9, the nut 9 will want to rotate in a direction that would tighten it on the tension rod 1 against the expansion device 4, rather than turning the nut 9 away from the expansion device 4. Preferably, if a threaded tension member 1 is used in connection which a threaded nut 9 as the fastening member 2, the surrounding sleeve 17 is oppositely threaded with respect to the tension member 1.

Figure 8:
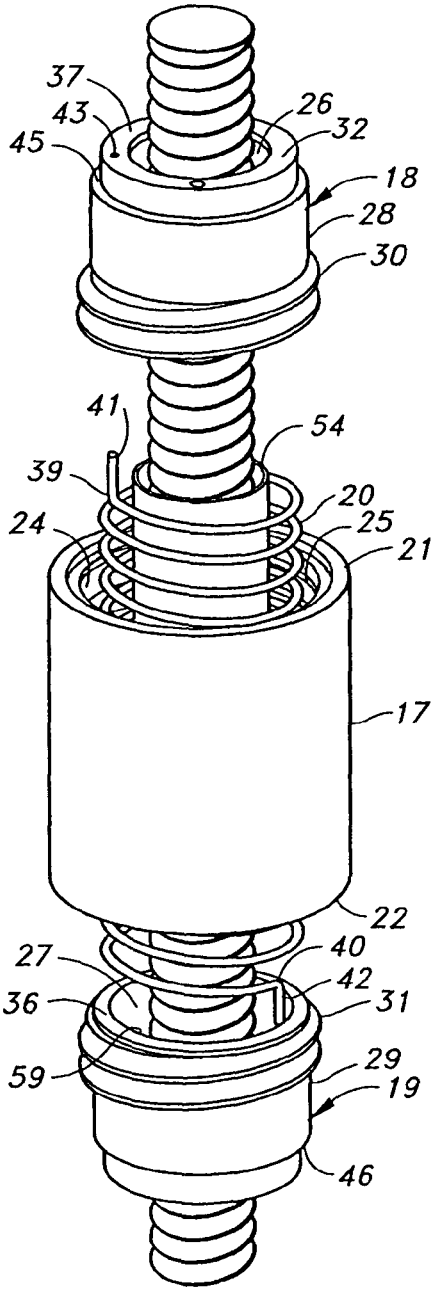
FIG. 8 is an exploded perspective view of the parts of an alternate expansion device inserted over a tension member. The means by which the expansion device retains its position on the tension member are not shown.
Figure 9:
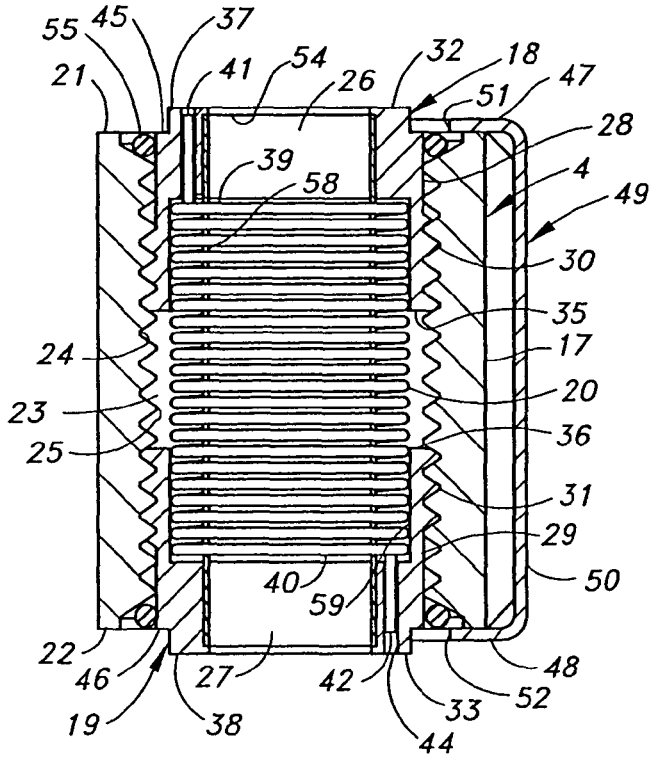
FIG. 9 is a cross-sectional side view of the surrounding sleeve of the alternate embodiment. The torsion spring is shown inserted into the surrounding sleeve over a sizing sleeve. The sizing sleeve is shown in cross-section. The first and second cylindrical bearing members are shown in cross-section. They are shown threaded into the surrounding sleeve in the cocked and ready position. The locking clip has been inserted over the expansion device to hold it in its ready position. The flanges of the locking clip engage the shoulders of the first and second cylindrical bearing members. The shoulders are aligned with the end surfaces of the surrounding sleeve.
Figure 10:
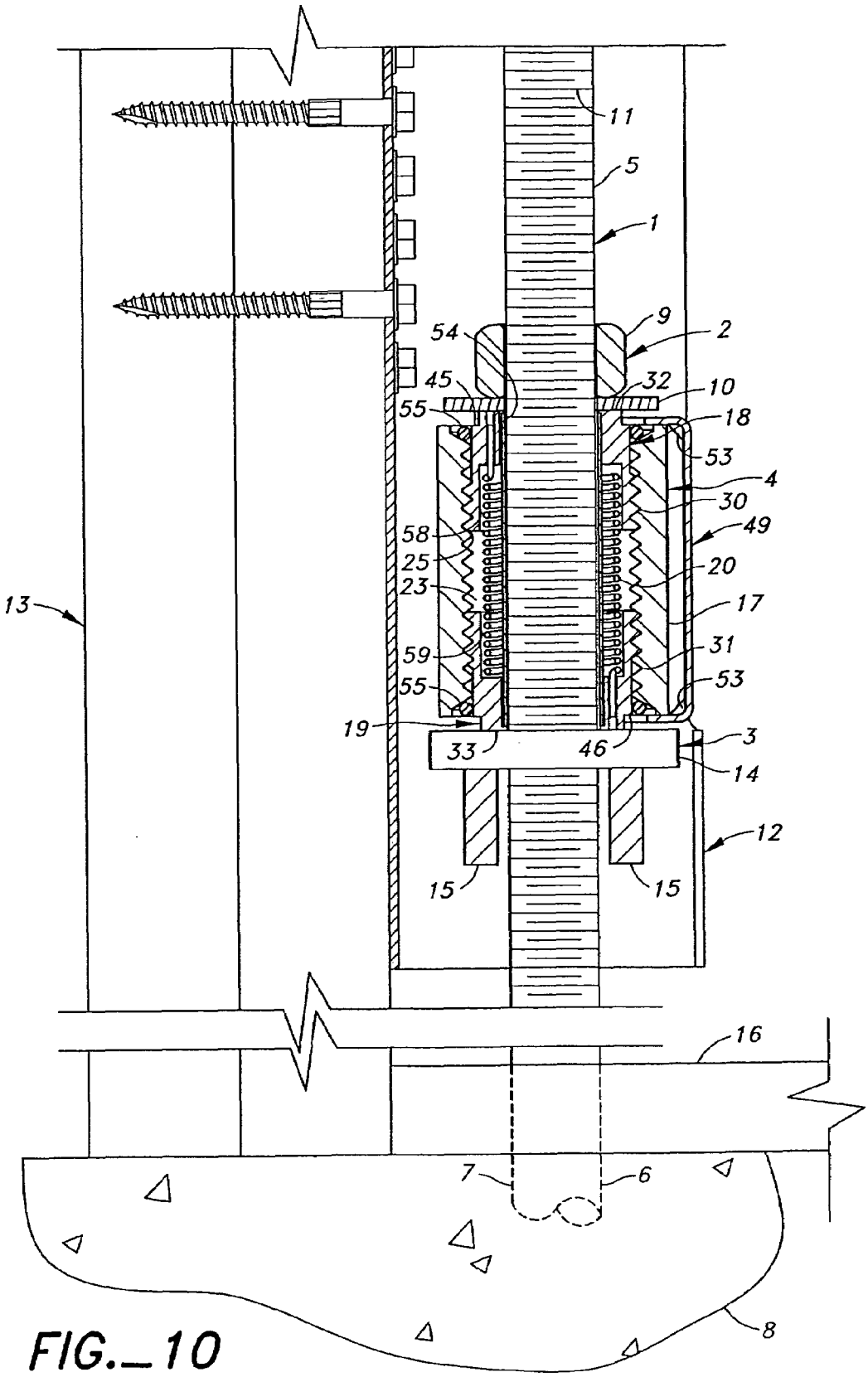
FIG. 10 is a view of the alternate embodiment similar to FIG. 4A.

FIGS. 8, 9 and 10 show a modified expansion device 4. The expansion device 4 of FIGS. 8, 9 and 10 is a smaller version of the device 4 shown in the earlier figures. However, the expansion device 4 still allows for a similar change in the length of the device 4 along the axial direction. This is made possible by forming annular recesses 58 and 59 in the cylindrical bearing members 18 and 19 that receive the torsion spring 20. Thus, a similarly sized torsion spring 20 can be fitted within a smaller surrounding sleeve 17. The inventor has found that a smaller device is preferable. For example, the tension rod 1 received by the expansion device 4 can be shorter.

The expansion device 4 is installed on a rod 1 or bolt in the following manner. A worker slips the expansion device 4 on the rod 1 or bolt. She then attaches a nut 9 and washer 10 or some other similar fastener to the rod 1 or bolt, such that a designated compression force is exerted on the expansion device 4 and there through onto a bracket 3 or plate. She then pulls the locking clip 49 away from the device 4 which allows the cylindrical bearing members 18 and 19 to move under the biasing force of the torsion spring 20 should the nut 9 and the bracket 3 or plate somehow separate.

I claim:

1. A connection, comprising:

a. an elongated tension member, having first and second ends, said elongated tension member being anchored at said second end and being connected to a structural member in a building at said second end, said building having a structural frame, said fastening member being disposed near said first end of said elongated tension member;

b. a fastening member attached to said elongated tension member at said first end;

c. a resisting member that receives said elongated tension member and is disposed between said fastening member and said second end of said tension member, said resisting member being connected to said structural frame of said building;

d. an expansion device that receives said elongated tension member there through and is compressively loaded between said fastening member and said resisting member by operation of said fastening member on said elongated tension member and said fastening member is only directly supported by said expansion device and said elongated tension member, said expansion device comprising, 1. a surrounding sleeve, having two ends, and a central aperture through which said elongated tension member is inserted, wherein a portion of said central aperture is formed as a substantially cylindrical inner surface and wherein at least a portion of said cylindrical inner surface is formed with a thread;

2. first and second bearing members received in said central aperture of said surrounding sleeve and operatively connected to said surrounding sleeve, said first and second bearing members also having apertures through which said elongated tension member is inserted, and wherein at least one of said bearing members has a cylindrical outer surface formed with a thread that mates with said thread of said cylindrical inner surface of said surrounding sleeve and is connected to said surrounding sleeve only by the mating attachment of said thread on said cylindrical outer surface with said thread of said surrounding sleeve, such that said at least one bearing member can rotate in relation to said surrounding sleeve, and said first and second bearing members are formed with outer axial ends, said outer axial end of said first bearing member contacting said fastening member, and said outer axial end of said second bearing member contacting said resisting member; and 3. a torsion spring connecting said first and second bearing members, said torsion spring biasing said first and second members in opposite rotational directions such that said at least one of said bearing members is forced to rotate along said thread of said surrounding sleeve away from said other bearing member and out of said surrounding sleeve, said torsion spring being disposed within said surrounding sleeve;

e. wherein said fastening member and said expansion device are only connected to said structural frame of said building by the attachment of the fastening member to said elongated tension member and by the receipt by the expansion device of the elongated tension member there through and by the contact of the expansion device with the resisting member.

2. A connection, comprising:

a. an elongated tension member, having first and second ends, said elongated tension member being anchored at said second end and being connected to a structural member in a building at said second end, said building having a structural frame, said fastening member being disposed near said first end of said elongated tension member;

b. a fastening member attached to said elongated tension member at said first end;

c. a resisting member that receives said elongated tension member and is disposed between said fastening member and said second end of said tension member, said resisting member being connected to said structural frame of said building;

d. an expansion device that receives said elongated tension member there through and is compressively loaded between said fastening member and said resisting member by operation of said fastening member on said elongated tension member and said fastening member is only directly supported by said expansion device and said elongated tension member, said expansion device comprising:

1. a surrounding sleeve, having two ends, and a central aperture through which said elongated tension member is inserted, wherein a portion of said central aperture is formed as a substantially cylindrical inner surface and wherein at least a portion of said cylindrical inner surface is formed with a thread;

2. first and second bearing members received in said central aperture of said surrounding sleeve and operatively connected to said surrounding sleeve, said first and second bearing members also having apertures through which said elongated tension member is inserted, and wherein at least one of said bearing members has a cylindrical outer surface formed with a thread that mates with said thread of said cylindrical inner surface of said surrounding sleeve and is connected to said surrounding sleeve only by the mating attachment of said thread on said cylindrical outer surface with said thread of said surrounding sleeve, such that said at least one bearing member can rotate in relation to said surrounding sleeve, and said first and second bearing members are formed with outer axial ends, said outer axial end of said first bearing member contacting said fastening member, and said outer axial end of said second bearing member contacting said resisting member;

3. a torsion spring connecting said first and second bearing members, said torsion spring biasing said first and second members in opposite rotational directions such that said at least one of said bearing members is forced to rotate along said thread of said surrounding sleeve away from said other bearing member and out of said surrounding sleeve, said torsion spring being disposed within said surrounding sleeve; and 4. wherein both of said bearing members have cylindrical outer surfaces formed with threads that mate with said thread of said cylindrical inner surface of said surrounding sleeve, and both of said bearing members are connected to said surrounding sleeve only by the mating attachment of said threads on said cylindrical outer surfaces with said thread of said surrounding sleeve, such that both of said bearing members can rotate in relation to said surrounding sleeve;

e. wherein said fastening member and said expansion device are only connected to said structural frame of said building by the attachment of the fastening member to said elongated tension member and by the receipt by the expansion device of the elongated tension member there through and by the contact of the expansion device with the resisting member.

3. The connection of claim 2, wherein:

a. said elongated tension member is at least partially formed with a thread where said fastening member attaches to said elongated tension member;

b. said fastening member attaches to said elongated tension member by means of an internal thread that mates with said thread of said elongated tension member; and c. said thread of said surrounding sleeve is threaded in the opposite direction as said thread of said elongated tension member.

4. The connection of claim 2, wherein said expansion device further comprises:

an inner sizing sleeve that is received by said surrounding sleeve and is disposed between said torsion spring and said elongated tension member.

5. The connection of claim 2, wherein said expansion device further comprises:

a locking clip that is releasably attached to said expansion device, said locking clip holding said first and second bearing members so as to prevent them from rotating under said influence of said torsion spring and causing said device to expand.

6. The connection of claim 2, wherein said expansion device further comprises:

a pair of annular seals disposed at said ends of said surrounding sleeve to protect said thread of said surrounding sleeve.

7. The connection of claim 2, wherein:

a. said torsion spring is formed with first and second ends; and b. said first and second bearing members are formed with annular recesses that can receive said ends of said torsion spring so that expansion device can be made more compact.

8. The connection of claim 2, wherein:

a. said elongated tension member has first and second ends and said fastening member, resisting member and expansion member are disposed near said first end; and b. said second end of said elongated tension member is connected to a structural member in a building.

9. The connection of claim 2, wherein:

at least a portion of said structural frame of said building is made from wood.

10. The connection of claim 2, wherein:

said thread of said surrounding sleeve near at least one of said ends of said surrounding sleeve is disturbed so that it is not possible for a bearing member traveling on said thread to pass all the way out of said surrounding sleeve.

11. The connection of claim 10, wherein:

a. said torsion spring is formed with first and second ends; and b. said first and second bearing members are formed with annular recesses that can receive said ends of said torsion spring so that expansion device can be made more compact.

12. The connection of claim 11, wherein:

a. said elongated tension member is at least partially formed with a thread where said fastening member attaches to said elongated tension member;

b. said fastening member attaches to said elongated tension member by means of an internal thread that mates with said thread of said elongated tension member; and c. said thread of said surrounding sleeve is threaded in the opposite direction as said thread of said elongated tension member.

13. The connection of claim 12, wherein said expansion device further comprises:

an inner sizing sleeve that is received by said surrounding sleeve and is disposed between said torsion spring and said elongated tension member.

14. The connection of claim 12, wherein said expansion device further comprises:

a locking clip that is releasably attached to said expansion device, said locking clip holding said first and second bearing members so as to prevent them from rotating under said influence of said torsion spring and causing said device to expand.

15. The connection of claim 14, wherein said expansion device further comprises:

a pair of annular seals disposed at said ends of said surrounding sleeve to protect said thread of said surrounding sleeve.

16. The connection of claim 2, wherein:

said torsion spring connects to said first and second bearing members near said outer axial ends of said bearing members.

17. The connection of claim 2, wherein:

said thread of said surrounding sleeve near at least one of said ends of said surrounding sleeve is disturbed so that it is not possible for a bearing member traveling on said thread to pass all the way out of said surrounding sleeve.

18. The connection of claim 17, wherein:

said torsion spring connects to said first and second bearing members near said outer axial ends of said bearing members.

19. The connection of claim 18, wherein said expansion device further comprises:

an inner sizing sleeve that is received by said surrounding sleeve and is disposed between said torsion spring and said elongated tension member.

* * * * *